US006379205B1

(12) United States Patent
Wallasch

(10) Patent No.: US 6,379,205 B1
(45) Date of Patent: Apr. 30, 2002

(54) RESCUE HOLDING CLAMP

(76) Inventor: Lutz Wallasch, 106 Archer Ave., Baldwin, NY (US) 11510

( * ) Notice: Subject to any disclaimer, the term of this patent is extended or adjusted under 35 U.S.C. 154(b) by 0 days.

(21) Appl. No.: 09/635,362

(22) Filed: Aug. 10, 2000

(51) Int. Cl.[7] ..... B63C 9/00; B63C 9/32

(52) U.S. Cl. ..... 441/80; 440/90; 441/82; 441/85

(58) Field of Search ..... 441/80, 82, 85, 441/69; 182/12, 16, 230; 440/90; 114/244, 245, 253, 315; 70/16, 19

(56) References Cited

U.S. PATENT DOCUMENTS

| | | | | |
|---|---|---|---|---|
| 3,626,892 A | * | 12/1971 | Humbert | 441/69 |
| 3,734,049 A | * | 5/1973 | Humbert | 441/69 |
| 3,830,188 A | * | 8/1974 | Humbert | 441/69 |
| 4,694,931 A | * | 9/1987 | Sibertin-Blanc et al. | 441/89 |
| 5,427,557 A | * | 6/1995 | Lunden, Sr. | 441/82 |

* cited by examiner

*Primary Examiner*—Sherman Basinger
(74) *Attorney, Agent, or Firm*—Alfred M. Walker

(57) ABSTRACT

A rescue clamp rescues precariously located victims, such as swimmers in water, such as seas, rivers, streams, ponds or swimming pools, climbers in deep ravines, persons on top of a burning building or persons fallen down a well. The rescue clamp includes an orifice clamp into which a victim inserts the hand and forearm. A handle trigger is grabbed by the victim's hand, to cause the clamp to snugly engage and grip around the victim's wrist or forearm. The rescue clamp grips the wrist or forearm by off-centered hour glass shaped jaws that rotate in unison to reduce the size of the orifice therebetween. To facilitate rotation, there is an eccentric off-center cam motion of the clamping jaws contributing to a grasping action in general. The clamping jaws automatically tighten around a victim's wrist or forearm. The rescue holding clamp automatically grabs a swimming or other remotely positioned victim's wrist or forearm when the rescue clamp is activated when the victim, such as a swimmer in a body of water or a climber in an inaccessible ravine or canyon, inserts the hand through an orifice created by movable clamps, grabs the trigger handle and pulls the trigger handle, thereby causing the rotation of the clamping jaws around the wrist or forearm of the victim.

24 Claims, 12 Drawing Sheets

RESCUE HOLDING CLAMP

This application is based upon Disclosure Document No.468982 filed Feb. 11, 2000.

FIELD OF THE INVENTION

The present invention relates to a rescue holding clamp which automatically grasps a swimming victim's wrist or forearm when a clamp is triggered by the victim grabbing a tripper element, which causes off-centered hour glass shaped jaws to rotate in unison to make an orifice formed there between small enough to grasp the wrist or forearm of the victim.

BACKGROUND OF THE INVENTION

In sea rescues, life preservers or other holding rings are dropped to a victim from a dock a boat or a helicopter. However, often the victim is exhausted, and cannot grasp the life preserver or ring.

To rescue precariously placed fire victims, various devices are used. Fire escapes and ladders can be used when the victim can be reached from the ground, but in high rise buildings only helicopter rescues from above are possible. These rescues normally include dropping a rope or cable with a ring to grab from a helicopter to the roof of a burning building.

Among related U.S. patents include the following:

| Patent No.: | Inventor: | Date: | Subject Matter |
|---|---|---|---|
| 1,611,427 | Evans | 12/21/26 | Navigation Aid |
| 3,332,415 | Ericson | 7/25/67 | Inflatable Splint |
| 3,348,632 | Swager | 10/24/67 | Climbing Device |
| 4,300,759 | Caplan | 11/17/81 | Inflatable Device |
| 4,596,530 | McGlinn | 6/24/86 | Rescue Device |
| 4,599,074 | Beckley | 7/8/86 | Rescue Device |
| 4,671,507 | Huttner | 6/9/87 | Exercise Sleeve |
| 4,694,931 | Sibertin-Blanc | 9/22/87 | Tripping Rescue |
| 4,778,033 | Gonzalez | 10/18/88 | Forearm Gripper |
| 5,279,386 | Cearly | 1/18/94 | Rescue Harness |
| 5,427,557 | Lunden | 6/27/95 | Ice Rescue Device |
| 5,752,731 | Crome | 5/19/98 | Victim Snare Pole |
| 5,832,563 | Simpson | 11/10/98 | Forearm Device |

Of these, U.S. Pat. No. 4,694,931 of Sibertin-Blanc for an Automatic Tripping Rescue System includes a sleeve into which a victim inserts the hand and forearm. It includes a handle tripper which causes the sleeve to snugly engage and grip the forearm.

However, the Sibertin-Blanc '931 device grips the forearm by an inflatable sleeve, which may take considerable time to inflate and from which a victim's hand could slip out of.

Other non-rescue personal flotation devices which grab the forearm or wrist are shown in the Evans '427, Caplan '759 and Gonzalez '033 patents. The Huttner '507 sleeve is a flotation device wrapped around a swimmer's ankles. The Ericson '415 patent device describes an inflatable first aid splint and the Simpson '563 device is a forearm cuff to attach to a tool, such as a broom, a canoe paddle or a shovel.

The Swager '632 patent is cited for a mountain climber's device containing a cam with teeth, where the serrations and eccentric off center cam motion contributes to a grasping action in general, although not particularly for a forearm sleeve.

The Cearly '386, McGlinn '530, Beckley '074 and Crome '731 rescue devices have body harnesses that automatically tighten around a victim and automatically cinch down.

The Lunden '557 device is an ice rescue device that uses gears to advance toward a victim.

However, the aforementioned devices do not have mechanical reliability, and some have to rely upon air pressure and internal springs, which could malfunction. Therefore there is a need for simplicity in a device, which can reliably and quickly grasp a victim's wrist or forearm in a rescue operation.

OBJECTS OF THE INVENTION

It is therefore an object of the present invention to provide a rescue clamp which can safely grasp and hold the wrist or forearm an exhausted swimming victim with minimal effort on the part of the victim.

It is also an object of the present invention to provide a rescue clamp which can be easily dropped to a victim from a dock, boat or helicopter.

It is further an object of the present invention to provide a rescue clamp which can rescue precariously placed fire victims upon burning buildings.

It is yet another object of the present invention to provide a rescue clamp which automatically tightens around a victim's wrist or forearm.

It is yet another object of the present invention to provide a rescue clamp which prevents a victim from losing grip while being lifted.

It is a further object of the present invention to provide a floatable rescue clamp for use on waters which can be advanced toward a victim in choppy, turbulent seas.

It is a further object of the present invention to provide a rescue clamp which can communicate voice instructions from a rescuer to a victim.

It is a yet another object of the present invention to improve over the disadvantages of the prior art.

SUMMARY OF THE INVENTION

In keeping with these objects and others which may become apparent, the present invention describes a rescue clamp to rescue precariously located victims, such as swimmers in bodies of water, i.e., seas, lakes, rivers, ponds, or swimming pools, also such as climbers in a deep ravine, persons on top of a burning building or persons who have fallen down a well or crevice.

The rescue clamp includes a clamp into which a victim inserts the hand and forearm. It includes a handle trigger which is grabbed by the victim's hand, to cause the clamp to snugly engage and grip the wrist or forearm of the victim.

For thin persons the clamp generally engages the wrist. For stockier, heavier persons, the clamp grasps the thicker forearm of the victim.

The clamp grips the wrist or forearm by off-centered hour glass shaped jaws, that rotate in unison to form an orifice therebetween, which is snug and small enough to grasp the wrist or forearm of the victim. The off-centered hour glass shaped jaws are eccentric in that they are not symmetrical about each respective top to bottom axis. The curvature tapers constantly, departing from a symmetrical pattern.

To facilitate rotation, there is an eccentric off-center cam motion of the jaws contributing to a grasping action in general.

The jaws automatically tighten around a victim's wrist or forearm and cinch down. The rescue holding clamp automatically grabs a swimming or other remotely positioned victim's wrist or forearm, when the clamp is activated when the victim, such as a swimmer in a body of water or a climber in an inaccessible canyon, inserts the hand through an orifice created by movable clamps, and grabs a grabber handle.

Upon the grabbing of the handle by the victim, the off-centered hour glass shaped jaws rotate in unison to make the orifice smaller. As the orifice gets smaller, the jaws snugly grab around the wrist or forearm of the victim.

Therefore, if the victim is semi-conscious and loses his or her grip on the handle, the wrist or forearm clamp retains its grip upon the victim's wrist or forearm, enabling the victim to be lifted.

If the victim is heavy in weight with thick forearms, the clamp closes as soon as the orifice between the pair of eccentric hour glass shaped jaws touches the forearm. For thinner persons, the victim has to pull the handle closer, so that by time that the orifice is small enough to touch the victim, it touches and grabs the wrist of the victim.

Moreover, for water rescue versions, the clamp is made of flotation type materials, such as rubber or foam.

In water rescues, the rescue clamp is dropped from a water's edge, from a dock, from a boat or from a helicopter over water and is directionally powered remotely by a pair of paddle wheels with step motors to reach the victim. While five inch diameter paddle wheels may be powered by, for example, a 7.2 volt motor mild waters, larger eight inch diameter wheels are the preferred embodiment for choppy waters in turbulent seas. In that case, the rescue clamp uses a more powerful power supply, such as for example, a 12 volt motor with 12 volt lead cell batteries, so that the rescue clamp can reach speeds which are multiples of the swimming speed of a human rescue lifeguard. For example, while ocean-going lifeguards reach speeds of three or four miles per hour, the rescue clamp of the present invention can go at least that fast, preferably multiples of these speed, such as fifteen miles per hour in speed, even on the ocean waves.

For ice rescues, the wheels may be studded wheels.

The rescue clamp is also useful for fire rescues on top of burning buildings, or in non-aqueous deep rescues (wells, ravines, etc.), in which situations, no wheels or flotation base are needed. In these situations, the rescue clamp can optionally have one or two handles. These rescue clamps can be dropped manually by a rescuer, or from a helicopter.

Furthermore, an optional one way or two way communications loud speaker may be provided so that the lifeguard or other rescuer can talk to the victim, and a siren or flashing light may be provided for locating the rescue clamp in areas of poor visibility, such as in fog or nighttime conditions.

BRIEF DESCRIPTION OF THE DRAWINGS

The present invention can best be understood in connection with the accompanying drawings, in which.

DETAILED DESCRIPTION OF THE INVENTION

As shown in the aforementioned drawing FIGS. 1–15, the rescue clamp of the present invention is a mechanical device which is self-powered in the clamping action around a victim's wrist or forearm. The intent is that the victim grab a handle through an opening in the rescue clamp which is tethered to a rescue line. As the line gets taut, the pulling force on the handle causes a clamping force of at least one pair of eccentric hour glass shaped clamping jaws, which clamping force is proportional to the pulling force to grab the victim's wrist or forearm. Even if the victim then loses his grip on the handle, the clamp alone is able to pull the victim to safety.

Figure 1:
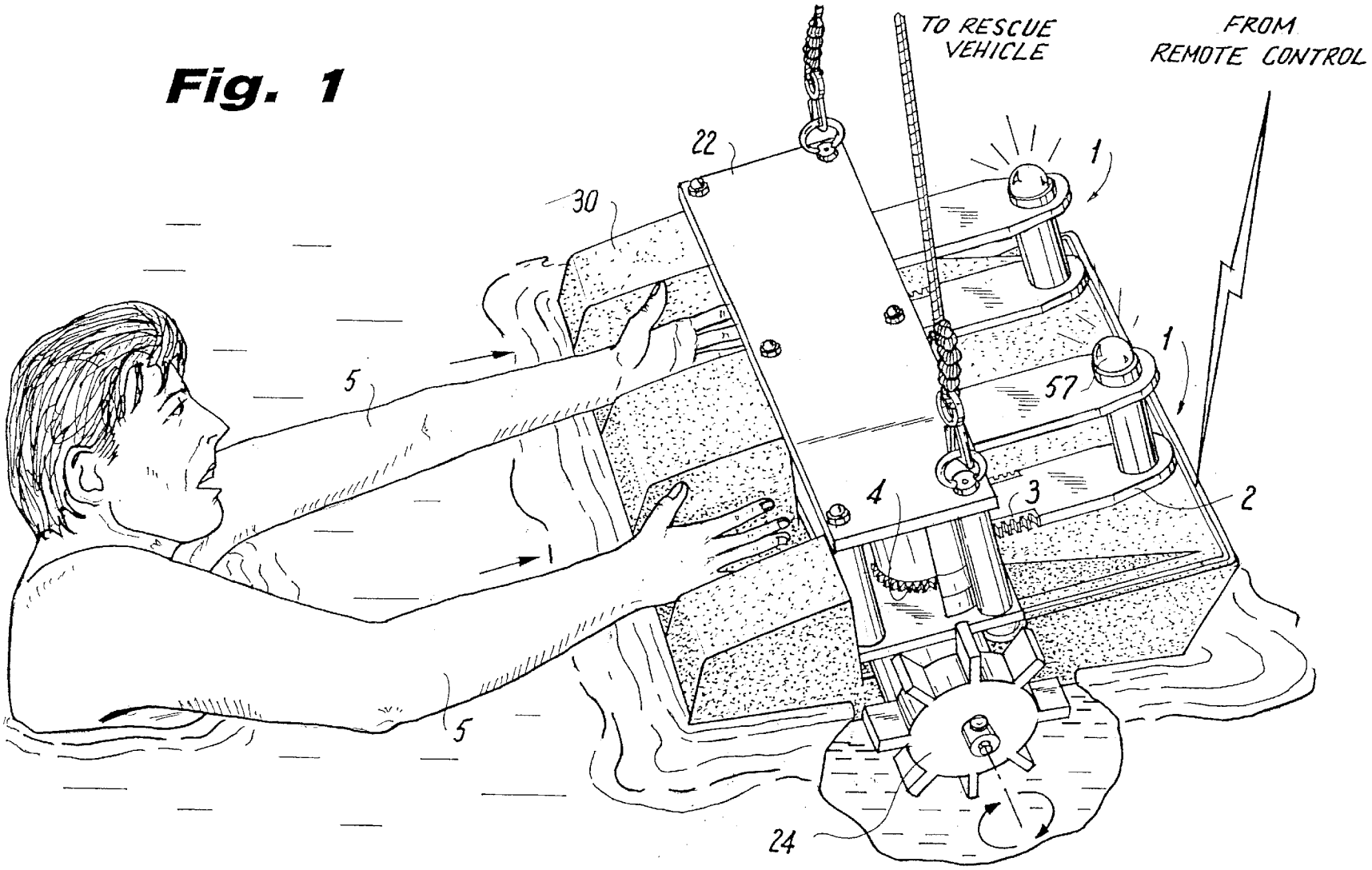
FIG. 1 is a side perspective view of a first embodiment for a rescue clamp of the present invention, which grasps both wrists or forearm of a victim.
Figure 2:
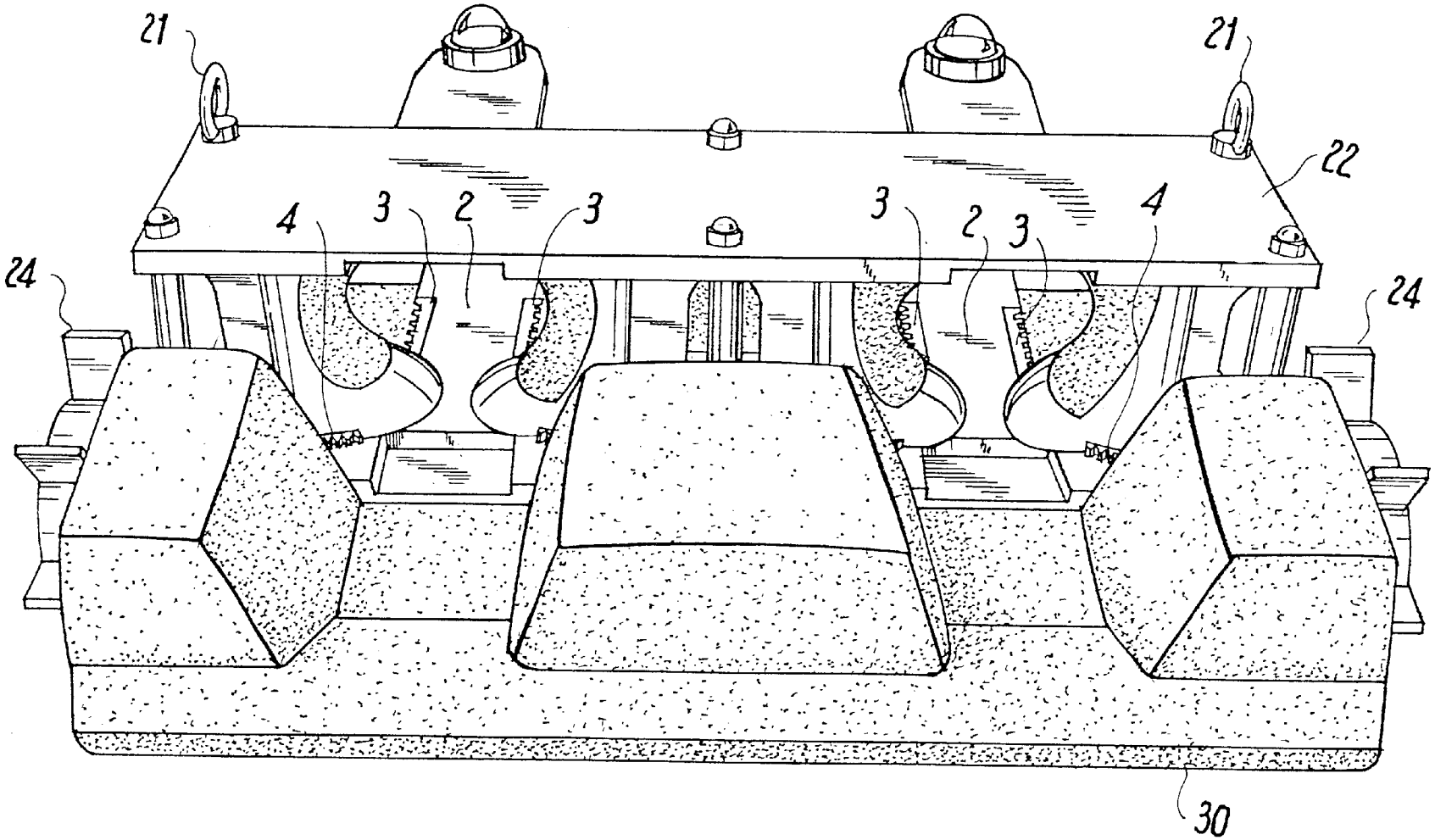
FIG. 2 is a front perspective view thereof, shown in an open position.
Figure 3:
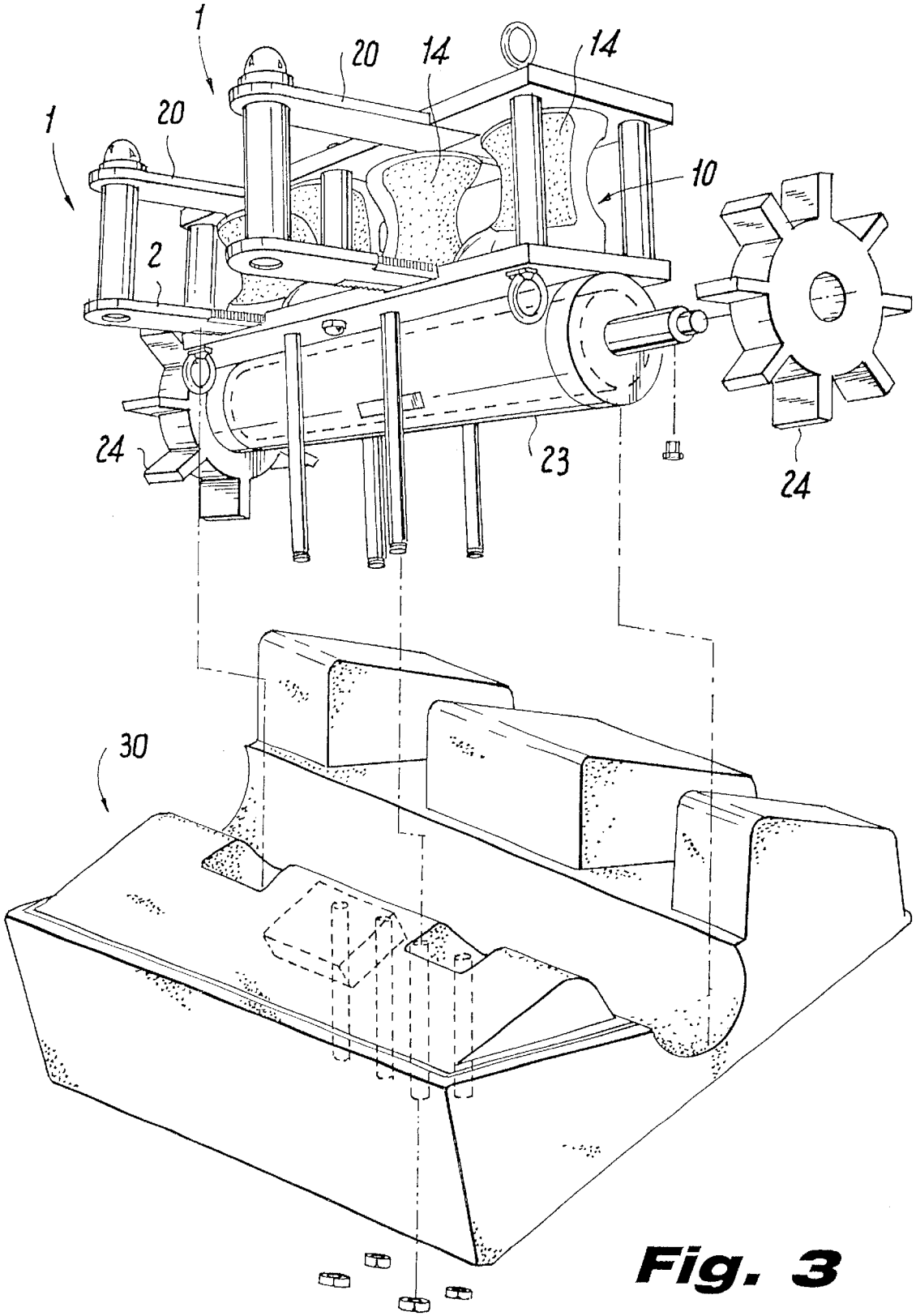
FIG. 3 is an exploded rear perspective view of the rescue clamp thereof.

FIGS. 1–3 show some of the essential parts of the rescue clamp mechanism. In FIG. 1 the victim's arms 5 are shown being inserted into the rescue clamp toward a pair of grasping handles 1, which are attached to movable bottom handle plate 2. A pair of gears 4 attached to a framework rotate by virtue of their engagement with gear racks 3 attached to the side edges of bottom handle plate 2.

FIGS. 2, 3, 5, 6 and 7 show pairs of eccentrically mounted hour glass clamping jaws 10 which are depicted in the open position, presenting an orifice therebetween, having a clearance at a distance away from the victim's arm 5.

The eccentric hour glass shaped jaws 10 act as eccentric off-centered cams. By "eccentric", it is meant that each hour glass shaped clamping jaw 10 is not symmetrical about its longitudinal axis extending from top to bottom. Rather, the curvature of the surface extending from top to bottom of each clamping jaw 10 departs from a symmetrical pattern.

Figure 10:
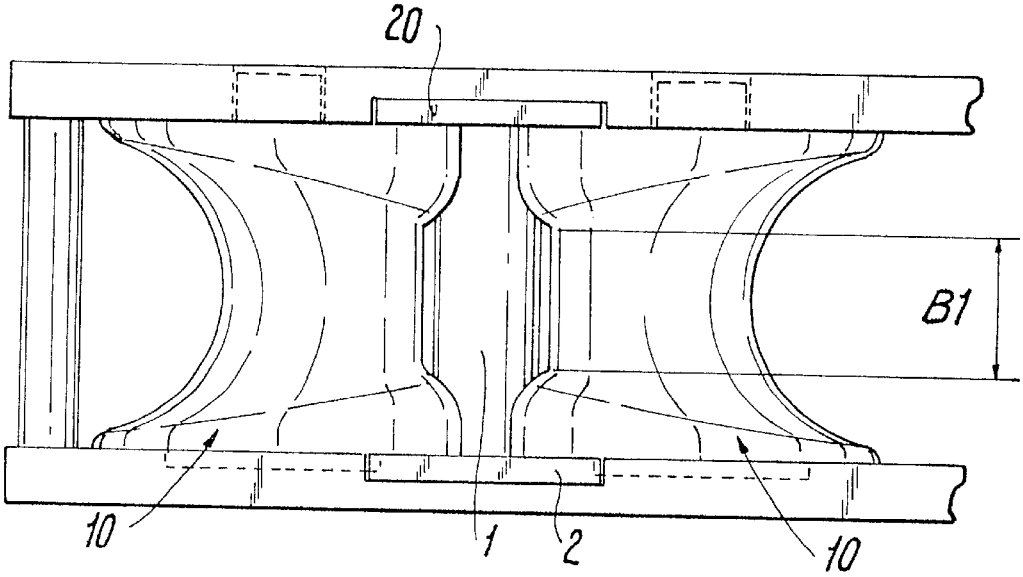
FIG. 10 is a close-up front elevational detail of the clamping jaws thereof, taken along lines 10—10 of FIG. 8, and shown in a closed clamping position.

Therefore each clamping jaw 10 has an eccentric axis of rotation, so that the observed space between the pair of clamping jaws 10 is an orifice with a constantly changing diameter. For example, shown in FIG. 7, the orifice therebetween has a first wide open horizontal diameter "A" and a wide open vertical diameter "A'", large enough for a victim to insert a hand therebetween. As shown in FIG. 10, clamping jaws 10 then close down to a narrower open horizontal diameter "B," and a narrower open vertical diameter "B'", which are small enough to enable the eccentric hour glass shaped jaws to clamp snugly about a victim's wrist or forearm 5.

Figure 9:
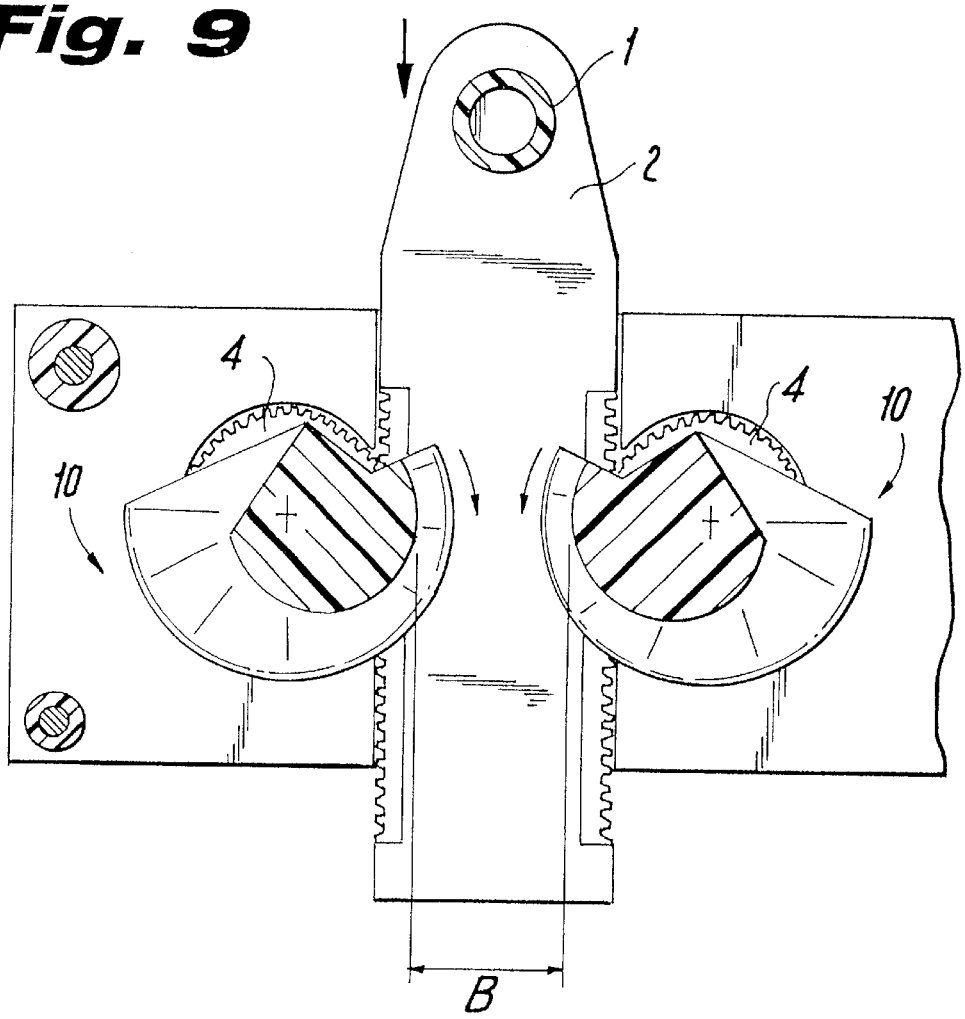
FIG. 9 is a top plan detail view of the handle and clamping jaws as in FIG. 6, taken along lines 9—9 of FIG. 8, and shown with the clamp in a partially closed position.

For example, in FIG. 9, the pair of clamping jaws 10 are shown partially closed, moving in the direction of the directional arrows therein. In FIG. 10, the pair of clamping jaws 10 are shown fully closed.

Figure 4:
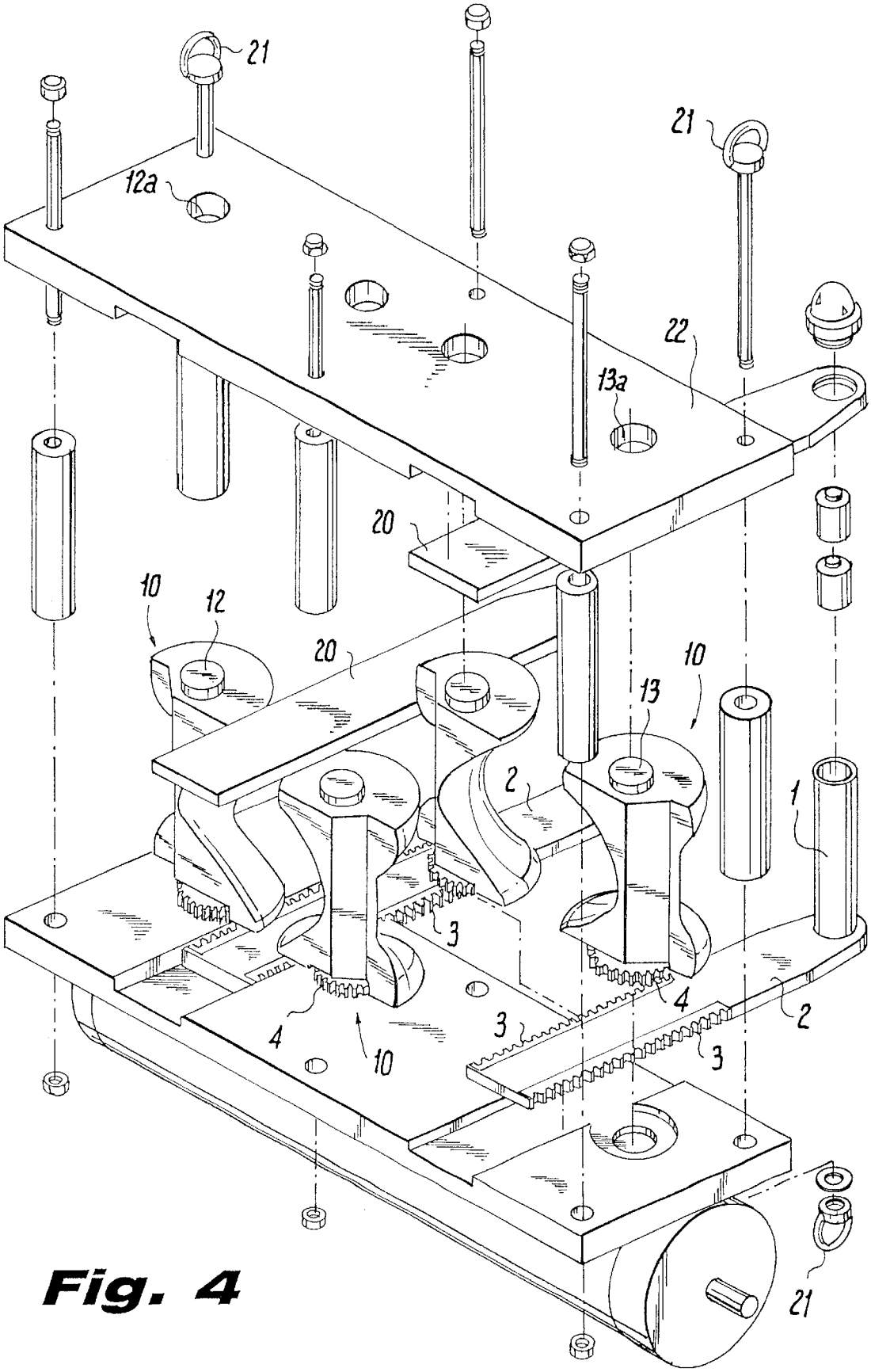
FIG. 4 is an exploded front perspective view in partial cross section, showing the eccentric pairs of hour glass clamping jaws of the rescue clamp thereof.
Figure 5:
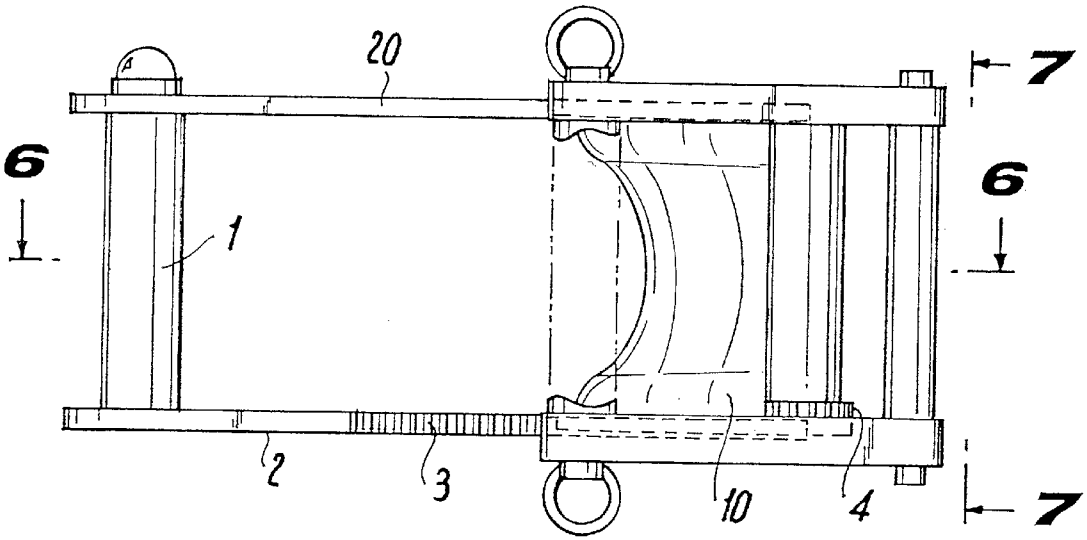
FIG. 5 is a close-up left side elevational detail view of a handle and clamping jaws thereof, shown in an open position.
Figure 8:
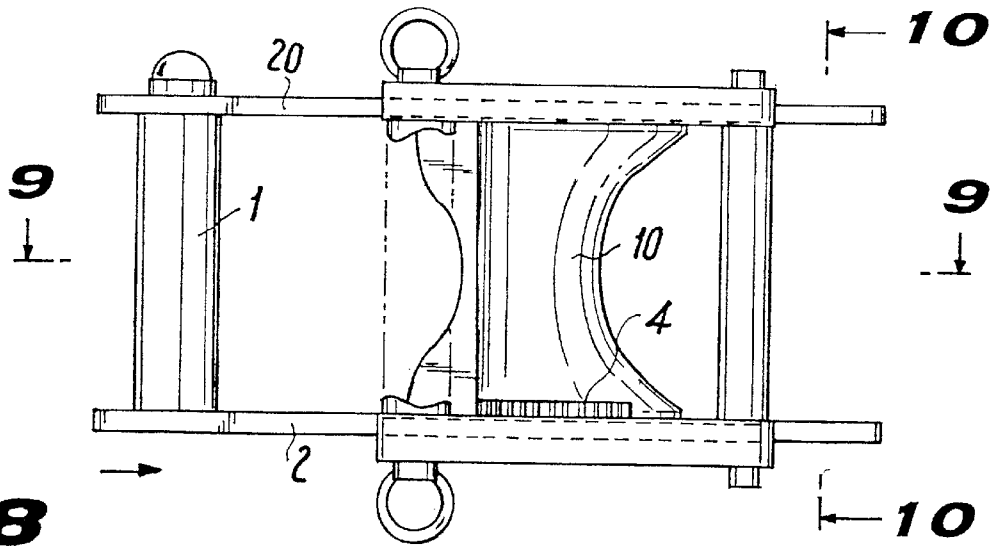
FIG. 8 is close-up left side elevational detail view of the handle and clamping jaws as in FIG. 5, shown in a closed position.
Figure 6:
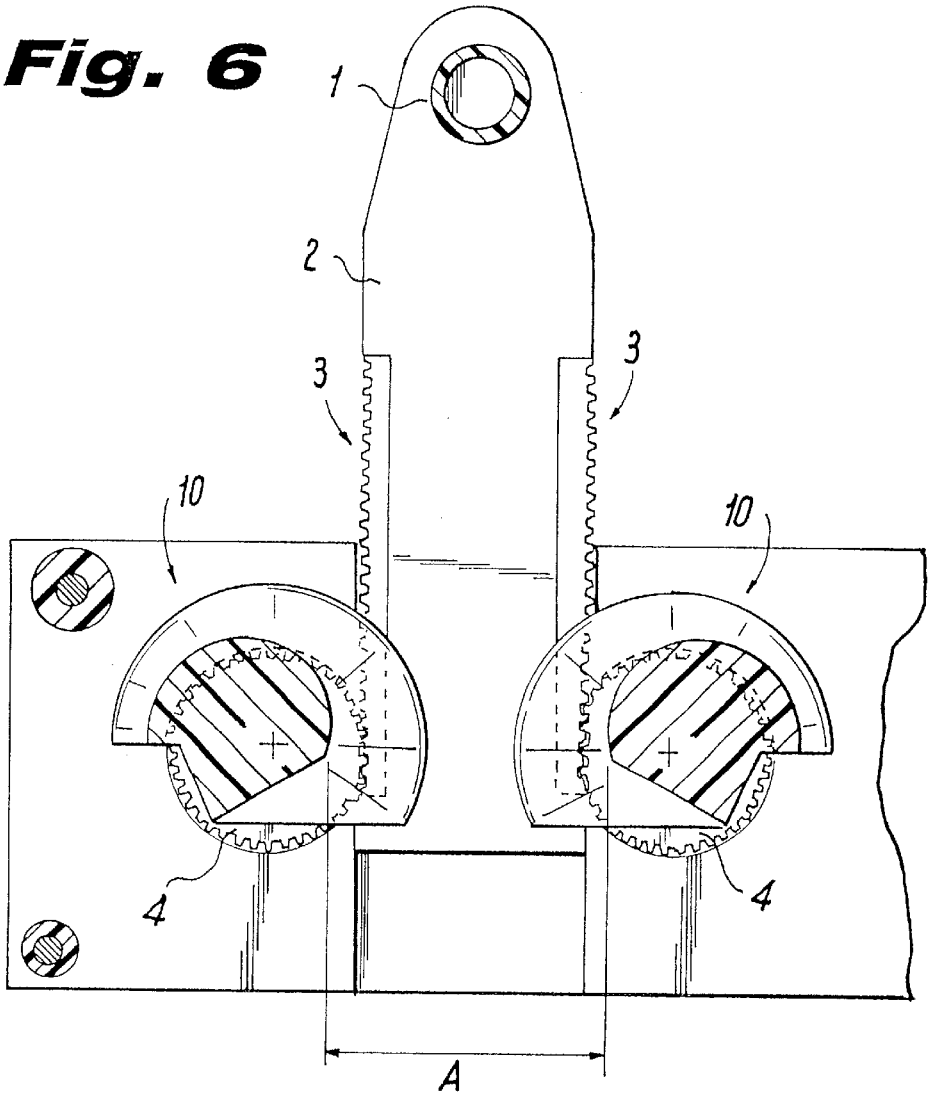
FIG. 6 is a top plan detail view of the handle and clamping jaws thereof in partial cross section, taken along lines 6—6 of FIG. 5 and shown in an open position.
Figure 7:
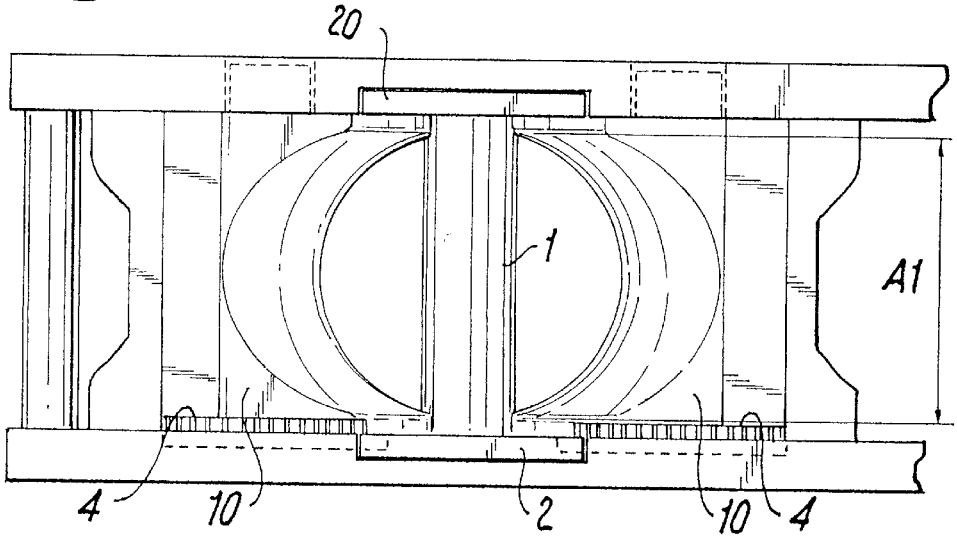
FIG. 7 is a close-up front elevational view of the handle and clamping jaws as FIG. 6, taken along lines 7—7 of FIG. 5 and shown in an open position.

As shown in FIG. 4, the axial centers 12, 13 of clamping jaws 10 rotate within respective apertures 12*a*, 13*a* of upper frame 22, as clamping jaws 10 are rotated by gears 4 moving along respective gear racks 3 of respective bottom handle plates 2 attached to drive gears 4 in an eccentric manner. As bottom handle plates 2 are pulled by the victim's arms 5, gears 4 rotate and turn eccentrically mounted clamping jaws 10 in toward arm 5, engaging the wrist or forearm thereof, as shown in FIG. 11.

Figure 11:
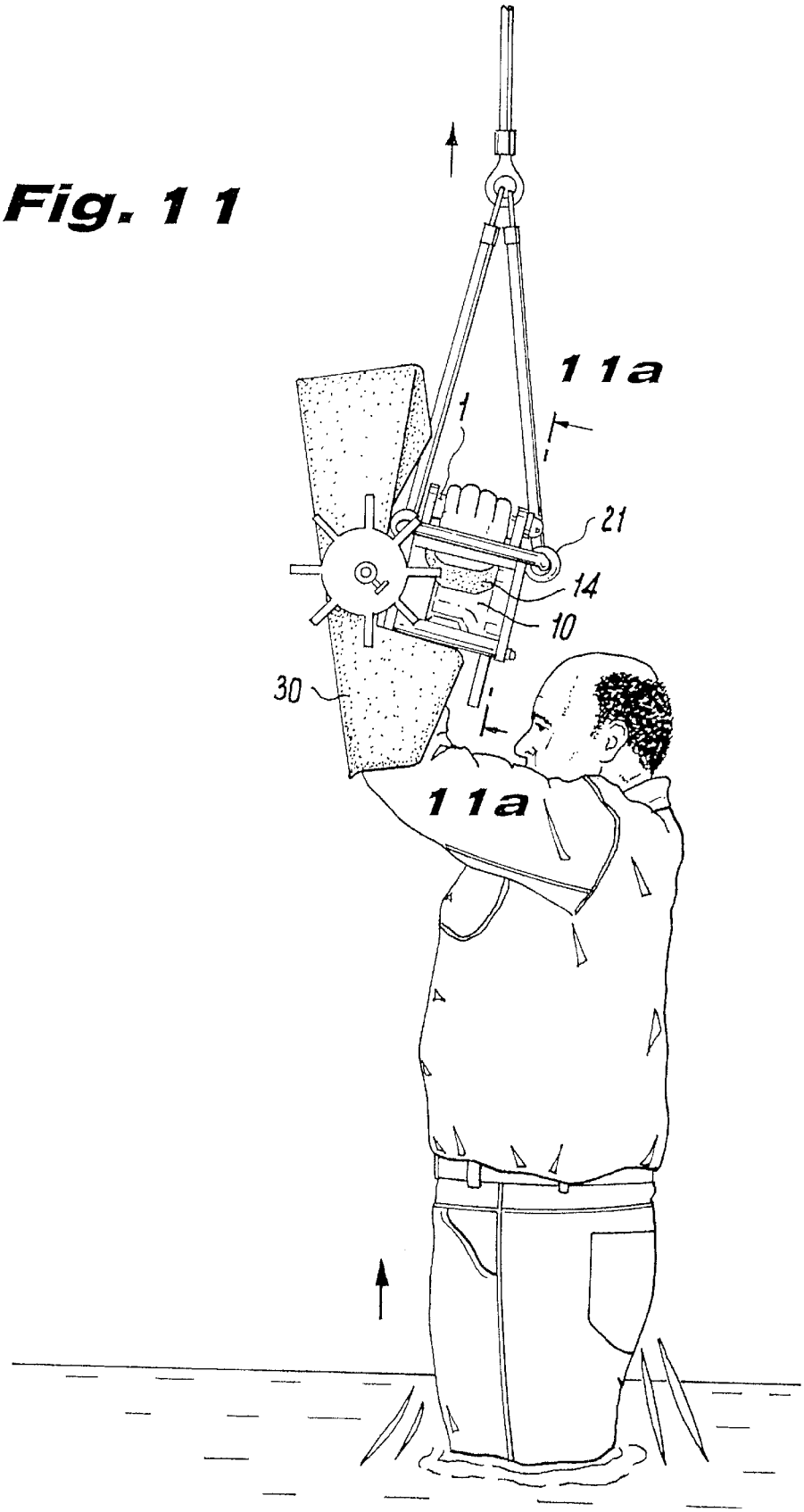
FIG. 11 is a perspective view of the rescue clamp as in FIG. 1, shown rescuing a victim from water.

As also shown in FIGS. 3 and 11, elastomeric bearing pads 14, attached to the respective surfaces of clamping jaws 10, rotate into position to grab arm 5 with minimal trauma.

FIGS. 1–4 show one embodiment for a two-arm rescue clamp assembly with two pairs of clamping jaws 10 to grasp both wrists or forearms 5 of the victim. Therefore, the rescue clamp also includes frame 22, top moving plates 20, rescue line attachment loops 21, paddle wheels 24 and drive modules 23. As also shown in FIG. 1, optional flashing lights 57, such as xenon flashers, may be provided.

FIGS. 5–10 more clearly illustrate hour-shaped clamping jaws 10 and how they move in conjunction with handles 1 to reduce the size of the respective orifices between pairs of clamping jaws 10.

To facilitate floating of the rescue clamp upon water, FIGS. 1 and 2 show the two-arm rescue clamp assembly mounted on a properly contoured closed-cell floatation base 30, made of rubber or floatable foam materials as are known to those skilled in the art.

FIG. 1 also shows the two-arm rescue clamp assembly on base 30 floating in a ready position with one of the paddle wheels 24 showing submerged about 30 percent. The directional arrows of FIG. 1 show the rotation of paddle wheels 24 toward the victim.

Figure 11A:
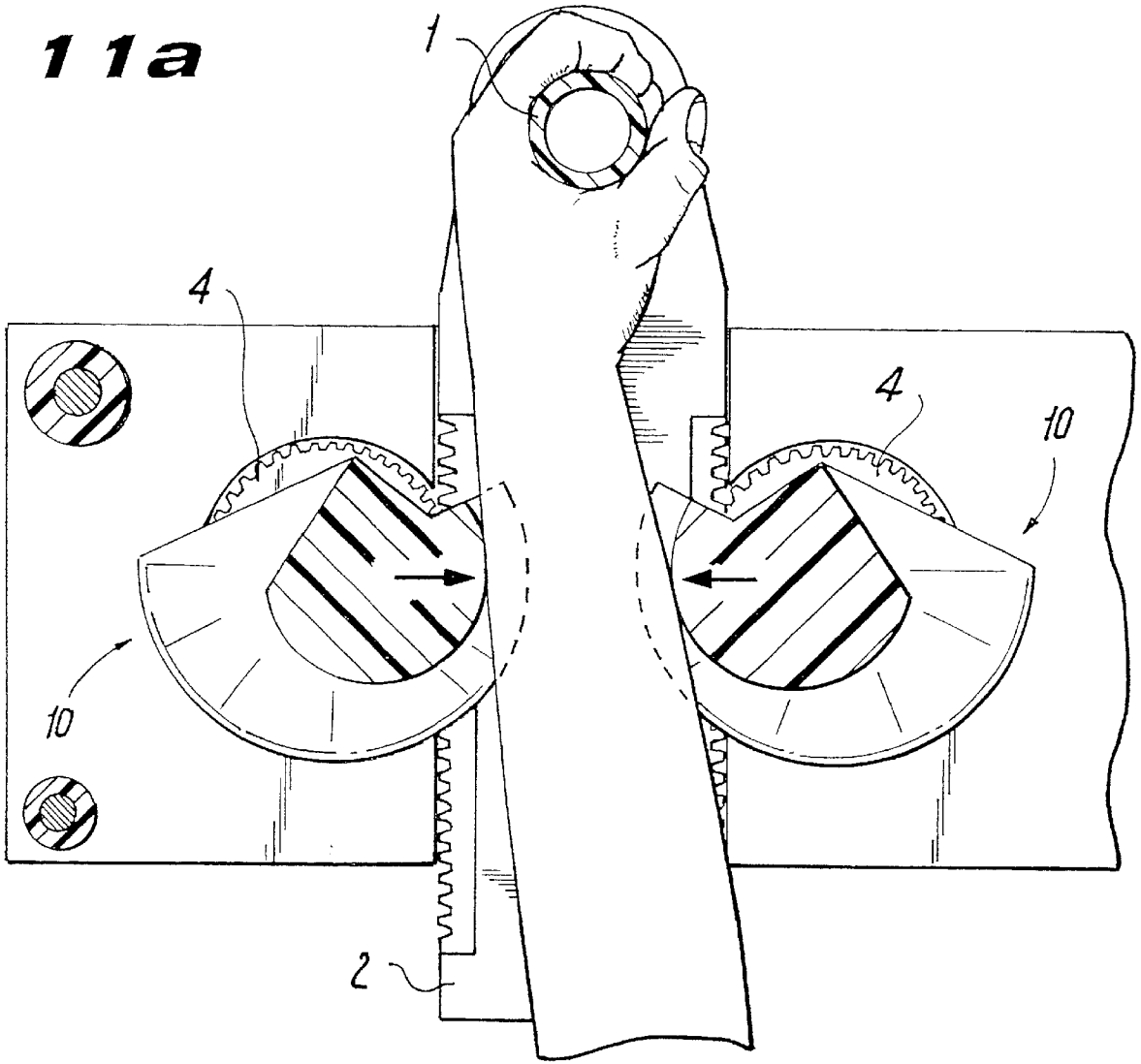
FIG. 11*a* is a top view of the rescue clamp as in FIG. 11, taken along lines 11*a*—11*a* of FIG. 11, showing the victim's arm grabbing the handle to actuate the clamping jaws thereof.

FIGS. 11 and 11A show a water rescue victim, with the victim's wrists or forearms 5 depicted within the opening formed by clamping jaws 10, after the victim grabs handles 1.

Figure 14:
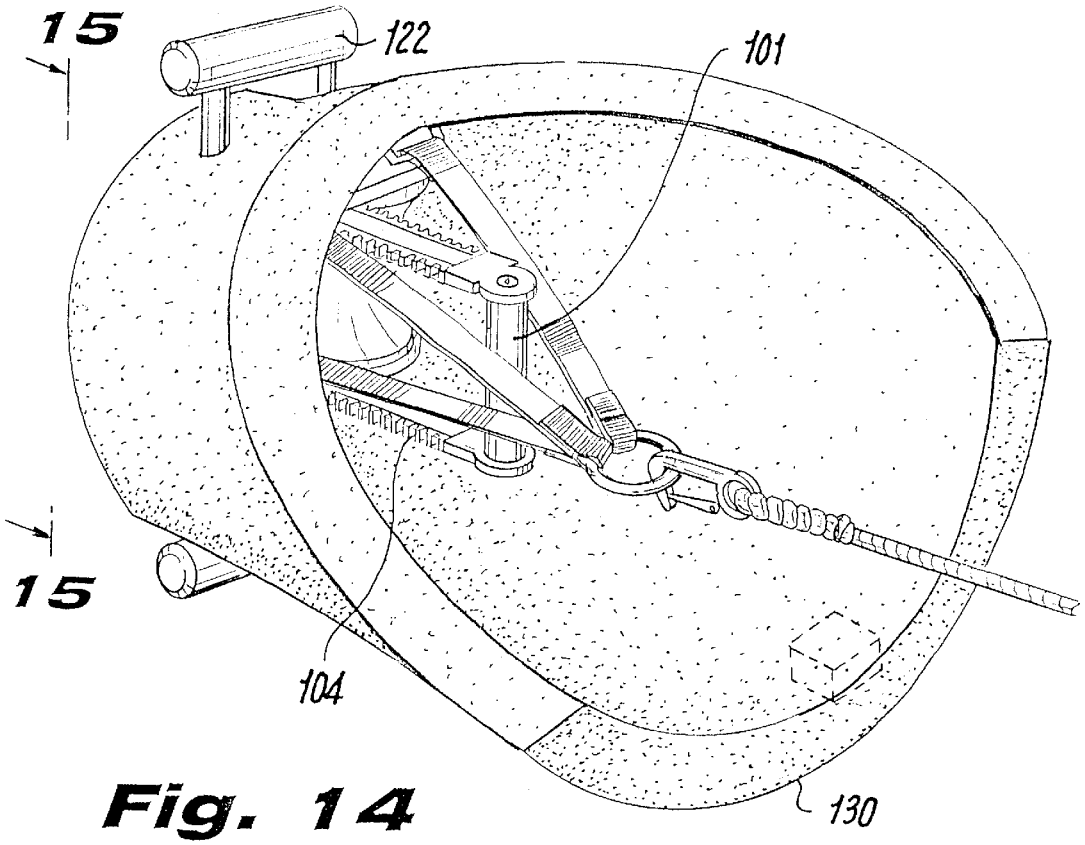
FIG. 14 is a rear perspective view of a further alternate embodiment for a rescue clamp for a single wrist or forearm.
Figure 15:
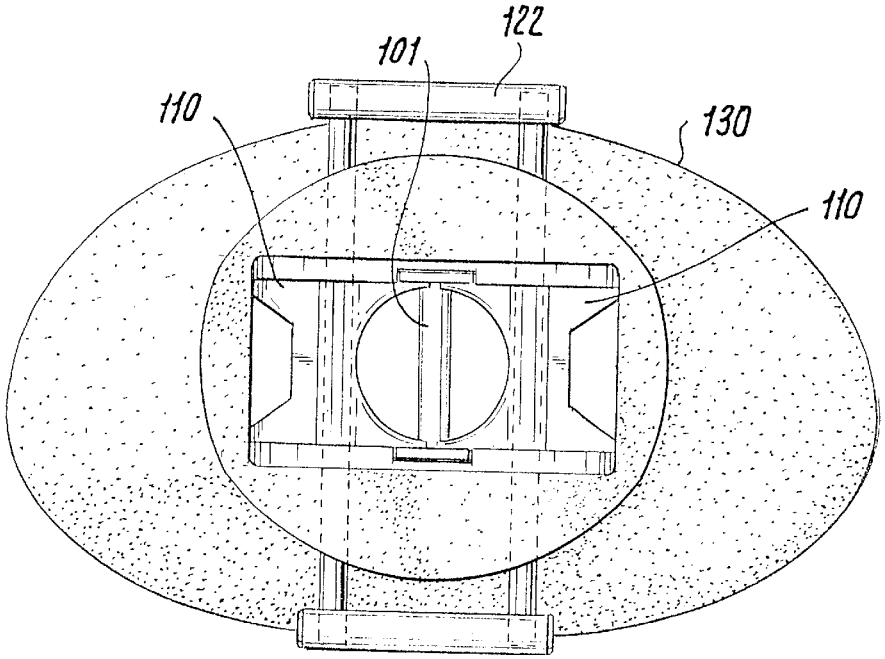
FIG. 15 is a front elevational view thereof, taken along lines 15—15 of FIG. 14.

While another embodiment for a non-motorized single arm rescue clamp shown in FIGS. 14 and 15 is ideal for some applications, such as a helicopter rescue from a canyon or a rescue in tight quarters such as for a victim in a well, or small lake, stream, swimming pool or crevice, the embodiment for a two-arm rescue clamp shown in FIGS. 1–11 is better suited for rescuing victims from larger bodies of water or ice pond hazards.

Figure 12:
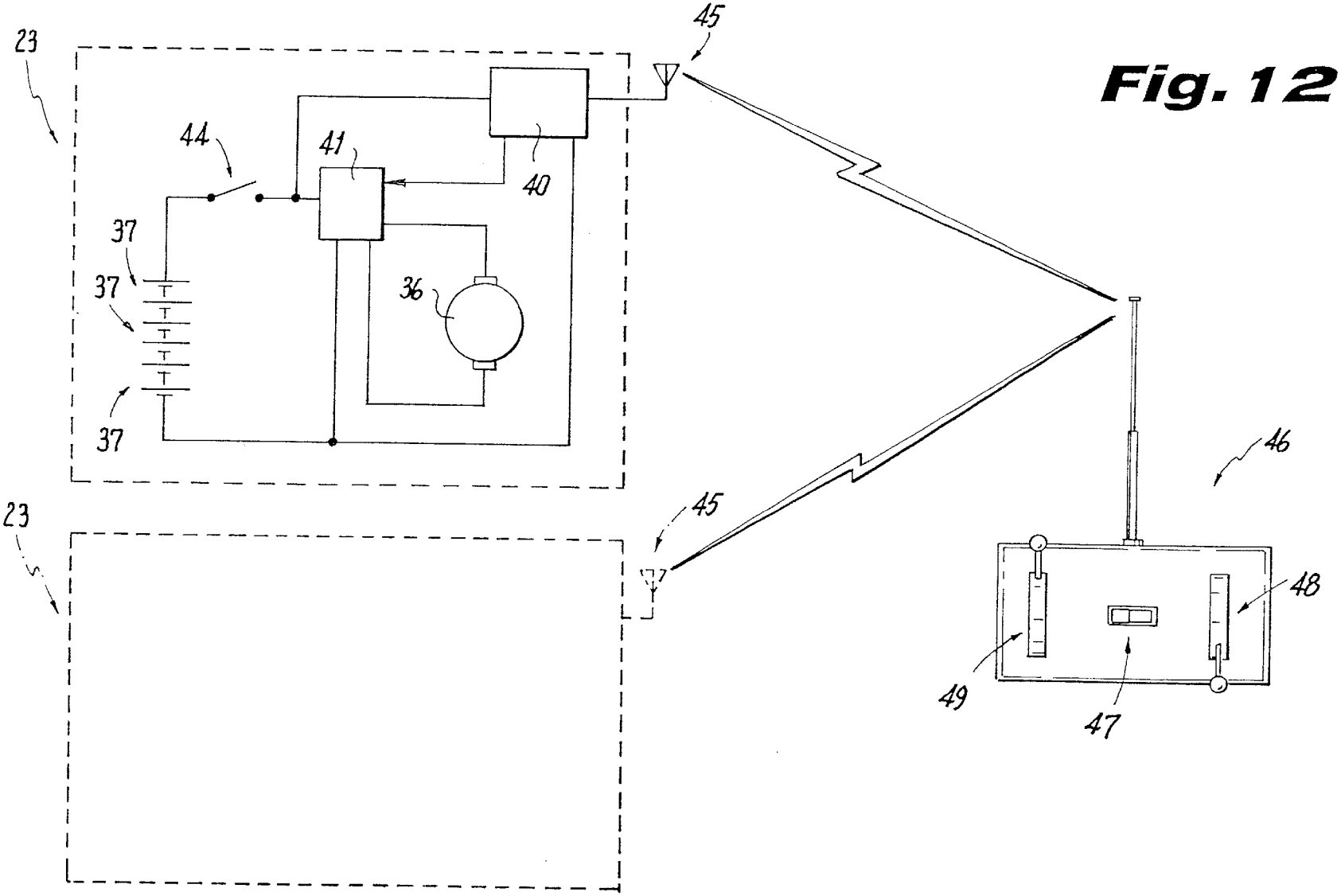
FIG. 12 is a block diagram of the drive module and remote controller for the rescue clamp as in FIG. 11.

Additionally, some method of robotically motivating the water or ice bound rescue clamps toward the victims is desirable. For example, FIG. 3 shows remotely controlled drive module 23 with paddle wheels 24. FIG. 12, which also shows the remote control features, is an electrical schematic block diagram of the electrical and drive components of drive module 23 and its rescuer controlled remote controller 46. FIG. 12 shows that module 23 contains a power supply, such as for example, six 1.2 volt NiCad cells 37. A motor 36, such as a permanent magnet DC motor drives each paddle wheel 24.

While FIG. 12 shows that each paddle wheel 24 has its own motor 36, it is possible that a dual control motor (not shown) could independently control each paddle wheel 24.

Drive module 23 is covered by a waterproof gasketed cover which includes therein the electrical components shown in the remotely controlled block diagram of FIG. 12. For example, drive module 23 also contains receiver 40 and MOSFET direction and speed control 41. Separate receivers 40 and MOFSET direction and speed controls 41 for the opposite paddle wheel 24 may be sealed in drive module 23, so that no wire penetration of drive module 23 is required.

As further shown in FIG. 12 of the remotely operated system, each drive module 23 receives signals from a remote transmitter 46, which is a modified model boat type device. Remote transmitter 46 has an on/off switch 47, left paddle wheel slide control 49 and right paddle wheel control 48 which determine the direction and velocity of the paddle wheels 24.

Although the voltage of the power supply may vary, in the embodiment shown in FIG. 12 the six cells 37 in the drive module 23 are wired in series for a 7.2 volt supply; and switch 44 is set on before launch. Antenna 45 receives signals from transmitter 46 and is able to differentiate its own control signal from that for the other drive module.

MOSFET directional speed control 41 controls the operation of motor 36. By supplying the same power and direction to both motors 36, straight line motion in water is achieved.

Any differential rotation of respective paddle wheels 24 causes directional deviations in course to facilitate maneuvering of the rescue clamp assembly toward a victim.

For use on ice (such as an ice skating breakthrough accident), paddle wheels 24 can be modified to include sharp spikes (not shown) at their periphery to dig into the ice and provide traction. For this latter ice rescue application, guards (not shown) over the side and top periphery of paddle wheels 24 may preferably be used to prevent lacerations of the victim by sharp spikes.

While the two-arm rescue clamp with a floatation base and a remotely controlled drive module 23 described above will operate adequately on ponds, lakes and rivers where the water is calm, an alternate embodiment is desired for rougher sea water. In this embodiment, larger paddles such as those having an eight inch (20 cm) diameter or more are required. More powerful motors and a larger battery are also required for rough seas rescues.

Figure 13:
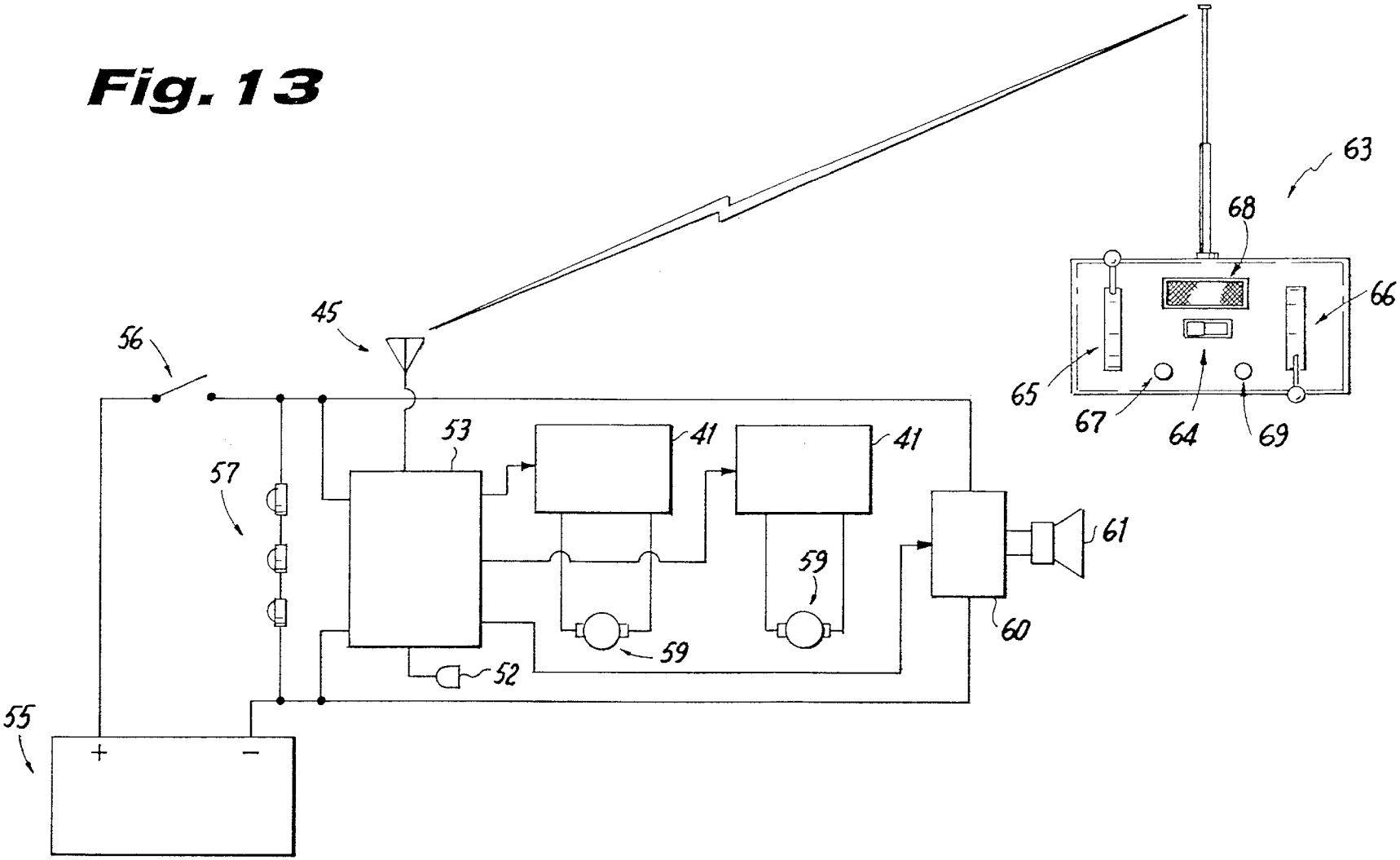
FIG. 13 is a block diagram of an alternate embodiment of a rescue clamp for use on rough seas.

FIG. 13 is a block diagram of such a rough sea rescue clamp system, which is enhanced with other features as well. The drive system uses a larger 12-volt lead acid battery 55 and a heavy-duty switch 56, which is set on prior to deployment. An optional set of illuminators, such as xenon flashers 57, is useful for night or fog rescue.

In FIG. 13, receiver 58 is actually a transceiver with an audio subchannel to emit siren sounds or verbal instructions to the victim via audio amplifier 60 and waterproof loudspeaker 61. The transceiver backchannel transmits sounds picked up by waterproof microphone 62 from the vicinity of the rescue platform (and the victim) to the remote control transceiver 63.

Control transceiver 63 has an on/off switch 64, left paddle and right paddle controls 65 and 66 respectively, microphone 67 for verbal instructions, siren button 69, and loudspeaker 68 to emit sounds picked up remotely.

While the embodiment shown in FIGS. 1–13 show a rescue clamp with two pairs of eccentric hour glass shaped clamping jaws 10 to accommodate both wrists or forearms 5 of the victim, in the further alternate embodiment shown in FIGS. 14–15 a single limb rescue clamp is shown with a single pair of clamping jaws 110 and a single handle 101. This embodiment for clamping a single wrist or forearm of the victim is better suited for rescues in a well, small lake, stream, swimming pool or crevice.

Furthermore, instead of the rigid frame 22 shown upon a flotation base 30 as in FIGS. 1–11, the entire housing for this single limb clamp may be a floatable, buoyant sleeve 130, wherein the single pair of eccentric hour glass shaped jaws 110 rotate about smaller frame 122 by means of gear racks 104. Buoyant sleeve 130 may be oriented in an upright position by a counterweight underneath, shown in dotted lines, to keep the buoyant sleeve afloat in an upright position while approaching the victim.

It is further noted that other modifications may be made to the present invention without departing from the scope of the present invention, as noted in the Appended Claims.

I claim:

1. A rescue clamp to rescue precariously located victims, including at least one of swimmers in water, climbers in a deep ravine, persons on top of a burning building and persons fallen down a well, comprising:

at least one clamp into which a victim inserts the hand and forearm, said clamp having at least one grab bar handle which is grabbed by the victim's hand, said grab bar handle causing at least one pair of eccentric hour glass shaped jaws to rotate in unison to form a snug orifice therebetween, said orifice closing from a first open wide position accommodating the insertion of a wrist or forearm therein to a predetermined smaller narrower closed position small enough to grasp the wrist or forearm of the victim, said jaws of said at least one pair of eccentric hour glass shaped jaws acting as eccentric off center cams around the victim's wrist or forearm, whereby said pair of eccentric hour glass shaped jaws automatically tightens around the victim's wrist or forearm and automatically cinches down, wherein further as said orifice gets smaller, said jaws of said at least one pair of eccentric hour glass shaped jaws snugly grab around the wrist or forearm of the victim, retaining a grip upon the victim's wrist or forearm, enabling the victim to be lifted by a tow cable extending from a remote rescuer to said rescue clamp.

2. The rescue clamp as in claim 1 wherein said at least one clamp comprises a pair of clamps.

3. The rescue clamp as in claim 1 wherein said at least one pair of eccentric hour glass shaped jaws comprises two pairs of eccentric hour glass shaped jaws.

4. The rescue clamp as in claim 1 further comprising said rescue clamp being tethered to a rescue line, wherein as said line gets taut, a pulling force on said handle causes a clamping force grabbing the victim's wrist or forearm within said rescue clamp, to pull the victim to safety.

5. The rescue clamp in claim 1 wherein said at least one pair of eccentric hour glass shaped jaws rotate about a pair of drive gears attached to respective gear racks, said eccentric hour glass shaped jaws rotatable by engagement with said gear racks.

6. The rescue clamp as in claim 1 wherein for water rescue versions, said rescue clamp is mounted upon a floatation support base.

7. The rescue clamp as in claim 1 further comprising respective elastomeric bearing pads being provided to respective inside surfaces of said jaws.

8. The rescue clamp as in claim 1, further comprising at least one remotely controlled motor advancing said rescue clamp over water toward the victim.

9. The rescue clamp as in claim 8 wherein said rescue clamp is directionally powered remotely by a pair of paddle wheels to reach the victim.

10. The rescue clamp as in claim 9 wherein each said paddle wheel is powered by a 7.2 volt direct current motor for use in mild waters.

11. The rescue clamp as in claim 9 wherein for choppy waters in turbulent seas, each said paddle wheel is directionally powered by a 12 volt direct current motor.

12. The rescue clamp as in claim 9 wherein each said paddle wheel of said pair of paddle wheels is independently moved by said remotely controlled motor.

13. The rescue clamp as in claim 12 wherein each said remotely controlled motor is located within at least one waterproof drive module housing, said at least one drive module housing containing at least one set of battery cells, each said set of battery cells powering each said motor driving each said respective paddle wheel.

14. The rescue clamp as in claim 13 wherein said at least one drive module housing contains a respective remote control receiver and a respective MOSFET direction and speed control for each said motor driving each said paddle wheel.

15. The rescue clamp as in claim 14 wherein said at least one drive module housing has at least one receiver receiving radio signals from a remote transmitter.

16. The rescue clamp as in claim 15 wherein said remote transmitter includes an on/off switch, a pair of paddle wheel slide controls determining predetermined direction and velocity of each said paddle wheel, said transmitter communicating with respective switches within said drive module, said drive module receiving signals from said transmitter.

17. The rescue clamp as in claim 16 wherein differential paddle wheel rotation causes deviations in a directional course of said rescue clamp traversing a body of water to facilitate maneuvering of said rescue clamp toward a victim.

18. The rescue clamp as in claim 16 further comprising each said paddle wheel having sharp spikes at each respective periphery thereof to dig into ice and provide traction during ice rescues.

19. The rescue clamp as in claim 16 further comprising a set of illuminated flashers provided for one of night and fog identification.

20. The rescue clamp as in claim 14 wherein each said receiver is a remote control transceiver with an audio subchannel emitting siren sounds and verbal instructions to the victim via an audio amplifier and a waterproof loudspeaker, wherein a transceiver backchannel transmits sounds picked up by a waterproof microphone from the vicinity of said rescue clamp and the victim to said remote control transceiver.

21. The rescue clamp as in claim 13 wherein said at least one drive module housing comprises a pair of drive module housing, each said drive module housing independently driving a respective remotely controlled motor of a pair if remotely controlled motors, each said remotely controlled motor independently controlling a respective paddle wheel of said plurality of paddle wheels.

22. The rescue clamp as in claim 1 further comprising a communications system including a loud speaker communicating audibly perceptible sounds from a rescuer to the victim.

23. The rescue clamp as in claim 22 wherein said communications system further includes a two way communication system between the rescuer and the victim.

24. The rescue clamp as in claim 22 further comprising a siren emitting sounds for locating said rescue clamp in areas of poor visibility.

* * * * *